United States Patent [19]

Greer

[11] Patent Number: 4,722,100

[45] Date of Patent: Feb. 2, 1988

[54] MAKEUP AND CLOTHING PROTECTOR

[76] Inventor: Barbara J. Greer, 2812 Vixen La., Silver Spring, Md. 20906

[21] Appl. No.: 488,024

[22] Filed: Apr. 25, 1983

[51] Int. Cl.[4] ..... A42B 1/04

[52] U.S. Cl. ..... 2/174; 2/205

[58] Field of Search ..... 2/174, 198, 202, 205

[56] References Cited

U.S. PATENT DOCUMENTS

| | | | |
|---|---|---|---|
| 1,398,165 | 11/1921 | Whiteside | 2/202 X |
| 2,064,032 | 12/1936 | Roberts | 2/174 |
| 2,372,715 | 11/1945 | Ernst | 2/174 |
| 2,420,916 | 5/1947 | Sorge | 2/174 |
| 2,445,487 | 7/1948 | Lester et al. | 2/174 |
| 2,447,561 | 8/1948 | Brenner | 2/174 |
| 2,519,512 | 8/1950 | Stone | 2/171 |
| 2,769,980 | 11/1956 | Fleischer | 2/174 |
| 3,064,267 | 11/1962 | Tullos | 2/174 |
| 4,133,052 | 1/1979 | Hodgman et al. | 2/174 |
| 4,173,042 | 11/1979 | Morris | 2/197 |
| 4,218,777 | 8/1980 | Munnikhuysen | 2/9 |

FOREIGN PATENT DOCUMENTS

| | | | |
|---|---|---|---|
| 0555542 | 4/1958 | Canada | 2/174 |
| 0953456 | 5/1949 | France | 2/202 |

*Primary Examiner*—Peter Nerbun

*Attorney, Agent, or Firm*—Walter C. Farley

[57] ABSTRACT

This invention relates to a head garment which can be used to protect a woman's makeup from a dress or the like and to protect the dress from makeup.

1 Claim, 4 Drawing Figures

MAKEUP AND CLOTHING PROTECTOR

BACKGROUND OF THE INVENTION

Several different kinds of female attire, notably dresses, sweaters and blouses, are donned over the head. Usually, one applies whatever makeup is used and prepares one's coiffure before putting on the garment. It is often difficult to prevent the garment from coming into contact with one's face during this process and, depending on the specific cut of the garment, it is often difficult to keep the garment from rubbing areas of makeup from the face or neck. This necessitates re-applying the makeup and redoing the coiffure with the garment on, an undesirable situation.

A similar problem arises in stores which handle women's clothing and wherein women wish to try on dresses and the like before deciding on a purchase. The stores are, of course, anxious to allow the women to try on the garments because it is only after seeing herself in a dress or the like that a woman can decide to purchase. However, a woman wearing a significant amount of makeup can leave enough of that makeup on a tried-on dress to make the dress somewhat less appealing to the next potential purchaser. The store is thus faced with the problem of cleaning its stock in some fashion without degrading the quality of that stock, and the woman is left with a disarrayed coiffure.

This general problem is, of course, not new. Solutions have been suggested and are shown in U.S. Pat. Nos. 2,447,561, Brenner, and 2,372,715, Ernst, in which head coverings to be temporarily worn while donning a garment are shown. However, in both cases, the head coverings are relatively complex, requiring expensive manufacturing steps and, in addition, can interfere with a hair arrangement, partially defeating the purpose.

BRIEF SUMMARY OF THE INVENTION

Accordingly, an object of the present invention is to provide an improved head covering which is simple in construction and can therefore be made inexpensively.

A further object is to provide such a head covering which can be formed from an inexpensive material and can therefore be a disposable covering usable in stores and the like frequented by the public.

Briefly described, the invention includes a makeup, hair and clothing protector comprising a substantially flat panel of pliable material having a main panel portion of generally rectangular shape having a front edge and a rear edge; and tie means integrally attached to said rear edge for attaching the protector over a user's head, said tie means including first and second end portions and a central portion, said central portion being fixedly attached to said main panel portion and forming a part of said rear edge of said main panel portion; said main panel portion having a front edge-to-rear edge dimension substantially equal to three times the vertical height of the user's head whereby said main panel portion can be draped over the head with the front edge thereof below the chin and covering the throat, the rear edge behind the neck and the end portions of said tie means passing around the neck to gather the lower extremities of the panel and be tied in front. In order that the manner in which the foregoing and other objects are attained in accordance with the invention can be understood in detail, particularly advantageous embodiments thereof will be described with reference to the accompanying drawings, which form a part of this specification and wherein:

Figure 1:
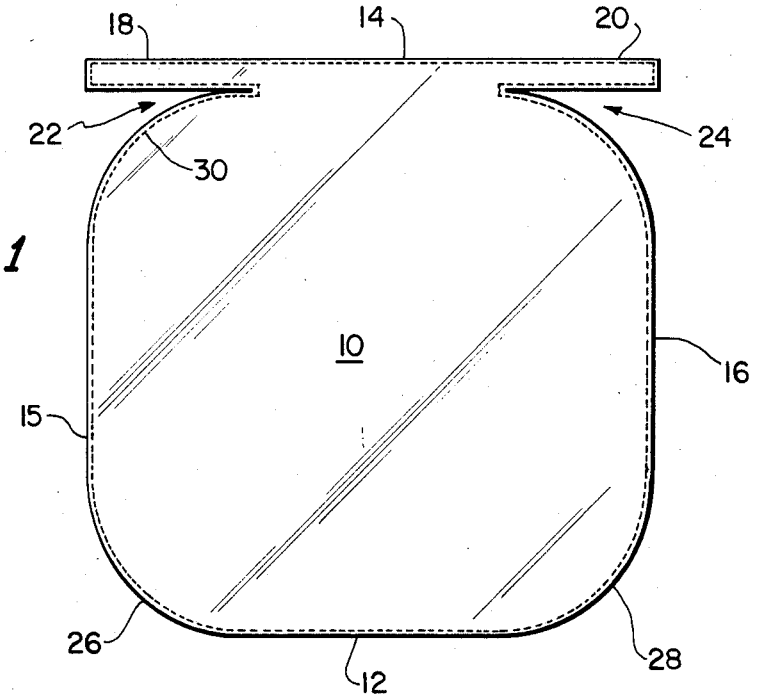
FIG. 1 is a plan view of a protective head covering in accordance with the invention in its spread-out form.

Turning now to the drawings in detail, it will be seen that FIG. 1 shows a plan view of a makeup and clothing protector in accordance with the invention as it might be spread out, lying in a single plane, on the top of a table. The protector includes a generally rectangular main panel portion 10 which has a front edge 12, a rear edge 14 and side edges 15 and 16. As will be recognized from the subsequent discussion, the front edge 12 is that portion which will, in use, be in front of the neck of the user.

The main panel portion is generally rectangular in shape, and is preferably approximately square with the distance between front and rear edges 12 and 14 being in the order of 30 inches. While the length can deviate to some degree from this dimension, being in the range of about 28 inches to about 32 inches and still have utility, it is important that the distance be in the order of three times the vertical height of the user's head, as measured from the point of the chin to the top of the head, so that when used it can extend from the lower portion of the neck in front to the lower portion of the neck in back, passing over the top of the head. While the width dimension is not as critical, it is conveniently approximately the same as the front-to-back dimension.

At the rear of the main panel portion 10 is a structure forming tie means having end portions 18 and 20. In effect, the tie means comprises end portions 18 and 20 along with a strip of material extending parallel with rear edge 14 and actually forming the rear edge of the main panel portion. As schematically shown in the drawing, end portions 18 and 20 are each about as long as one fourth of the width dimension of the entire panel, and central portion forming the rear edge of the main panel comprising about one half of that dimension. Thus, in a panel which is 30 inches between edges 15 and 16, each end portion 18, 20 is about 7.5 inches long, the section between those end portions being about 15 inches.

The embodiment shown in FIG. 1 is formed from a single panel of material which is cut inwardly at 22 and 24 to form slits defining the end portions, the adjacent corners of the main panel portion 10 then being rounded so that, in use, the protector does not have pointed corners depending around the head to interfere with clothing. The remaining corners 26 and 28 are similarly rounded, the radius of curvature of these corners being preferably about one fourth to one third of the length dimension of the panel.

As will be recognized, the article can be made from a number of different kinds of cloth fabric and paper. It is preferred that a diaphanous or partially transparent form of fabric or paper be used so that the user can readily see through the material. As is well known, a fabric which appears to be substantially opaque from a distance becomes relatively transparent as it is brought close to the face because of the increase in apparent size of the openings as the fabric is brought close to the eye. Thus, a relatively large number of thin cloth fabrics can be chosen for this purpose. Preferably, the edges of the fabric are hemmed as indicated at 30 to prevent unraveling and to inhibit tearing at the inner limits of slits 22, 24, although the hemming is not critical with some fabrics.

Figure 2:
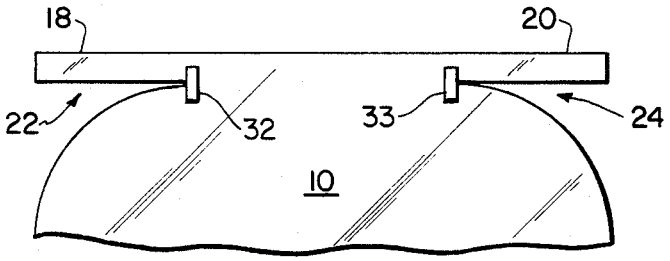
FIG. 2 is a partial plan view of a further embodiment of a makeup and clothing protector in accordance with the invention.

As shown in FIG. 2, the structure can be made of paper in a particularly convenient fashion by simply stamping the article from a flat sheet or panel of tissue or the like. It may be necessary with some lightweight types of paper, however, to add reinforcing strips 32, 33 at the inner ends of slits 22, 24 to prevent tearing. Making the article out of paper is a particularly advantageous embodiment for stores and the like because it can then be extremely inexpensive, permitting disposal after use by one person. It is contemplated that folded paper protectors in accordance with the invention can be supplied in a dispenser similar to that used for tissues or the like, the dispenser being mounted in the dressing room area of a women's clothing department or store. Thus, a woman entering the dressing room area can simply pull one of the protectors from a dispenser, use it while she is trying on selected garments, and then discard it after she has made her decision.

Figure 3:
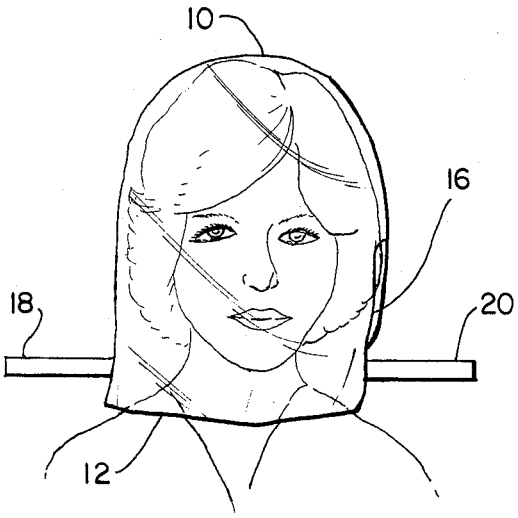
FIGS. 3 and 4 are schematic views of the manner of donning and wearing a protector in accordance with FIG. 1 or 2.
Figure 4:
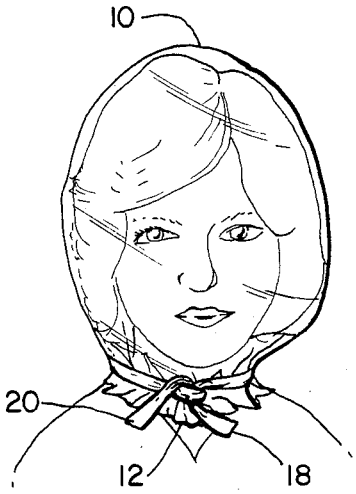

The manner of use is illustrated schematically in FIGS. 3 and 4, FIG. 3 showing the protector draped over the head with the front edge 12 lying approximately in a plane below the chin and near the lower portion of the neck, immediately above the clavicle. The central portion of the main panel rests on the top of the head and the rear edge lies behind the lower portion of the neck with end portions 18 and 20 forming the ties being held out to the side by the user's hands, the hands themselves not being shown in FIG. 3.

With the lower, front and back, edges of the protector in approximately the same plane, or perhaps with the front edge 12 slightly lower than the back edge 14, end portions 18 and 20 are brought around the sides of the neck to the front, surrounding and gathering in the material, the end portions being then tied in a simple overhand knot in front of the throat as shown in FIG. 4. Because of the diaphanous nature of the material, the protector can be left in that position while trying on a plurality of garments and, because of the secure nature of the tying arrangement, it has been found possible to put on and remove a number of garments, even those of types which fit rather snugly about the head as they are donned such as turtle-neck sweaters and the like.

It is particularly important that the dimension between edges 12 and 14 be sufficiently long so that the protector not only covers the face itself but comes well below the chin and covers the neck region because, in part, many women wear makeup on the neck as well as the face but, also, because it is important to be able to tie the end portions 18 and 20 below the chin, making the protector significantly more secure than otherwise.

While certain advantageous embodiments have been chosen to illustrate the invention, it will be understood by those skilled in the art that various changes and modifications can be made therein without departing from the scope of the invention as defined in the appended claims.

What is claimed is:

1. A makeup and clothing protector comprising a substantially flat panel of pliable material having a main panel portion of generally rectangular shape having a front edge, a rear edge and side edges wherein the edges are not secured to themselves or to each other; and tie means intergrally attached to said rear edge for attaching the protector over a user's head, said tie means including first and second end portions and a central portion, said central portion being fixedly attached to said main panel portion and forming a part of said rear edge of said main panel portion;

said main panel portion and said tie means being formed from a single rectangular panel of material having slits cut inwardly from opposite side edges thereof to form said end portions of said tie means;

said main panel portion having a front edge-to-rear edge dimension substantially equal to three times the vertical height of the user's head whereby said main panel portion can be draped over the head with the front edge thereof below the chin and covering the throat, the rear edge behind the neck and the end portions of said tie means being available to be passed around the neck to gather the lower extremites of the panel and be tied in front.

* * * * *